US005370190A

United States Patent [19]

Bigham

[11] Patent Number: 5,370,190

[45] Date of Patent: Dec. 6, 1994

[54] LAND LEVELLING MACHINE

[76] Inventor: Kenneth J. Bigham, 13 Oak Avenue, Boronia, Victoria, Australia, 3155

[21] Appl. No.: 84,089

[22] Filed: Jun. 28, 1993

Related U.S. Application Data

[63] Continuation of Ser. No. 466,290, May 30, 1990, abandoned.

[30] Foreign Application Priority Data

Oct. 2, 1987 [AU] Australia ..... 4690/87
May 12, 1988 [AU] Australia ..... 8196/88

[51] Int. Cl.[5] ..... E02F 3/76; E02F 3/815
[52] U.S. Cl. ..... 172/40; 172/59; 172/53; 172/101
[58] Field of Search ..... 172/40, 50, 59, 53, 172/101

[56] References Cited

U.S. PATENT DOCUMENTS 4,130,167 12/1978 van der Lely ..... 172/40
4,181,180 1/1980 van der Lely ..... 172/40 X
4,191,258 3/1980 van der Lely ..... 172/40
4,896,730 1/1990 Jarrett et al. ..... 172/40

*Primary Examiner*—Randolph A. Reese
*Assistant Examiner*—Christopher J. Novosad
*Attorney, Agent, or Firm*—Jacobson, Price, Holman & Stern

[57] ABSTRACT

A machine for levelling a surface has ground engaging levelling members pivotally mounted on a main frame for back and forth vibratory or oscillatory motion relative to the main frame in a normal direction of travel of the machine. Each levelling member has a longitudinal axis which extends laterally with respect to the normal direction of travel of the machine and there is an eccentric drive for providing the back and forth motion which may be connected to a power takeoff shaft of a tractor.

12 Claims, 2 Drawing Sheets

LAND LEVELLING MACHINE

This is a continuation of application Ser. No. 07/466,290, filed May 30, 1990 which was abandoned upon the filing hereof.

BACKGROUND OF THE INVENTION

This invention relates generally to levelling machines suitable for levelling surfaces such as for example, earth or ground. Whilst one application of the present invention relates to the levelling of earth the machine would also be suitable for levelling snow for example, on ski slopes or the like.

Currently known earth levelling machines generally comprise a large heavy blade which is adapted to be moved across the ground being levelled. Generally these devices are relatively heavy and difficult to manoeuvre and cannot be used in confined areas.

It is an object of the present invention to provide an improved levelling machine which alleviates one or more of the aforementioned problems.

SUMMARY OF THE INVENTION

According to the present invention there is provided a machine for levelling a surface, the machine being movable over the surface in a normal direction of travel and comprising a main frame, ground working means operatively connected to said main frame so as to be capable of vibratory or oscillatory motion relative thereto said ground working means including at least one ground engaging member which extends laterally with respect to the normal direction of travel of the machine.

Preferably the ground working means comprise a plurality of ground engaging members which are generally parallel to one another and extend generally laterally with respect to the normal direction of travel of the machine and are in spaced relation one behind the other with respect to the normal direction of travel of the machine. The or each said ground engaging member may collectively have a substantially flat ground engaging surface which, when the machine is in use, is inclined continuously with respect to the surface being worked, the forward edge of the surface being at a greater height above the surface being worked than the trailing edge. Preferably the ground engaging members are arranged in a plane which is, in use, inclined with respect to the surface being worked with the most forward ground engaging member being at a greater height above the surface being worked than the most rearward ground engaging member.

The vibratory or oscillatory motion preferably causes the ground working means to move generally back and forth relative to the main frame in the normal direction of travel of the machine.

In the preferred embodiment the ground working means is operatively connected to the main frame by a plurality of links, one end of each link being pivotally connected to the main frame and the other end of each link being pivotally connected to the ground working means. The arrangement is such that the ground working means is suspended by the links which permit the oscillatory or vibratory movement of the ground working means relative to the main frame.

Preferably vibration or oscillation generating means is provided which is operatively connected to the ground working means. The generating means may include an eccentric mounted on a rotatable shaft and a connecting member operatively connecting the ground working means to the eccentric.

A ground engaging roller may be mounted on the main frame rearwardly of the ground working means with respect to the normal direction of travel of the machine.

BRIEF DESCRIPTION OF THE DRAWINGS

A preferred embodiment of the invention will hereinafter be described with reference to the accompanying drawings in which.

DESCRIPTION OF THE PREFERRED EMBODIMENT

Figure 1:
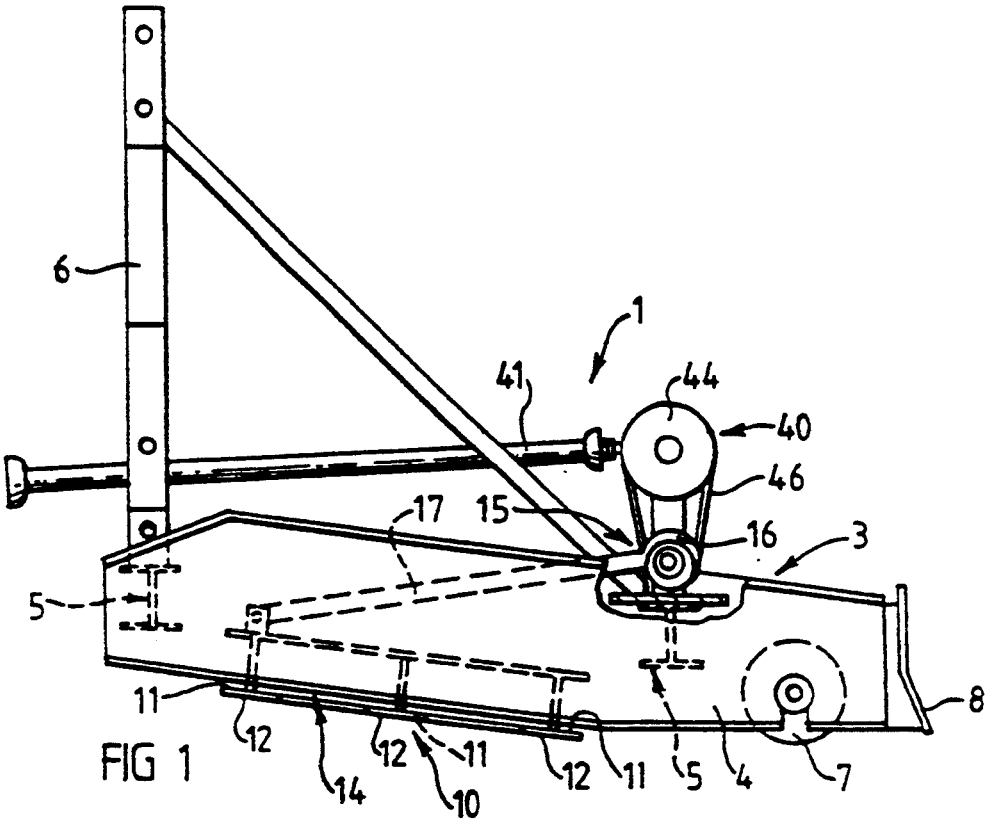
FIG. 1 is a schematic side elevation of a machine according to the present invention.
Figure 2:
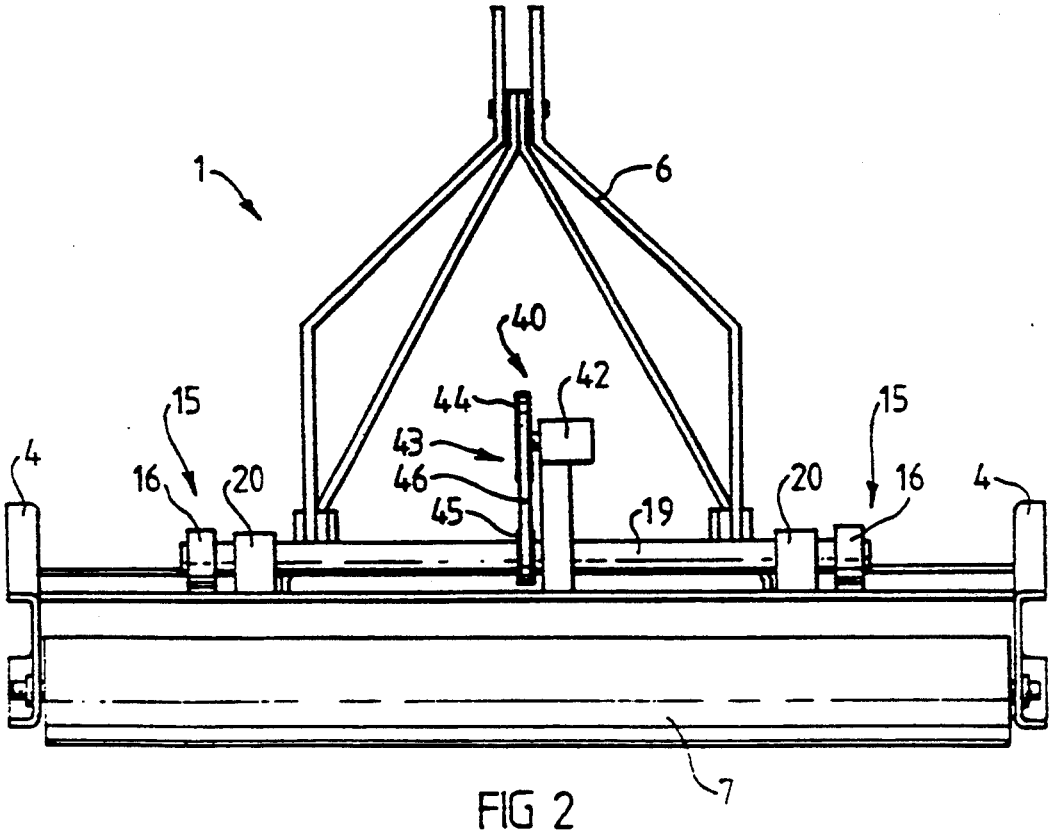
FIG. 2 is a front elevation of the machine shown in FIG. 1.
Figure 3:
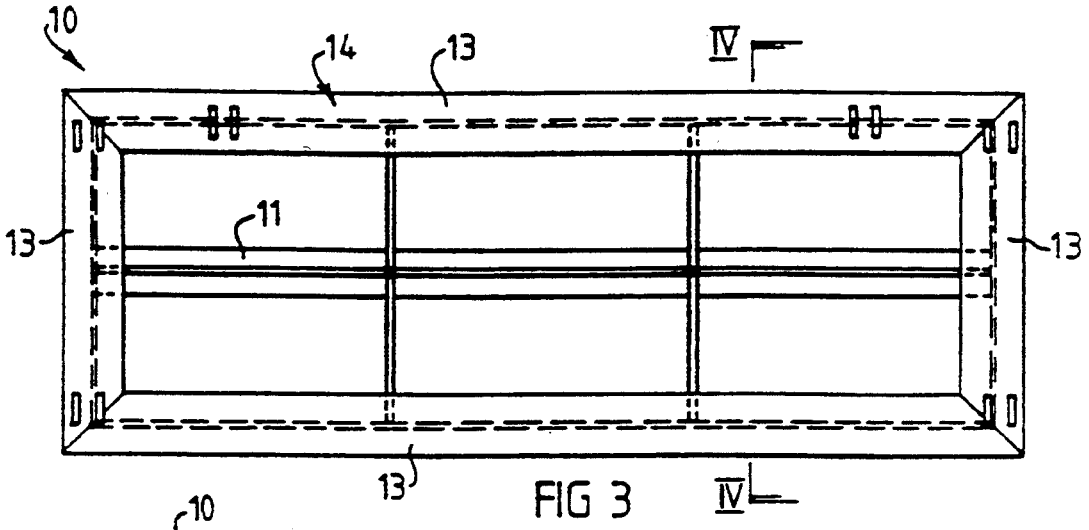
FIG. 3 is a plan view of one form of the ground working means suitable for use in the machine according to the present invention.
Figure 4:
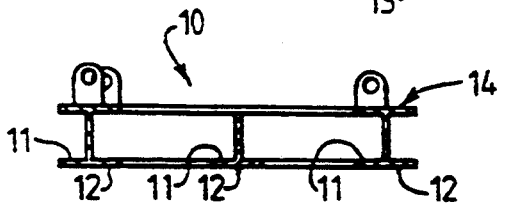
FIG. 4 is a side elevation of the ground working means shown in FIG. 3.
Figure 6:
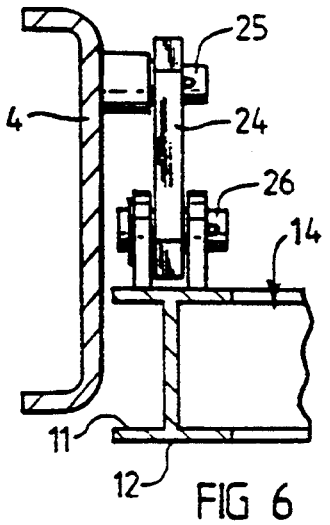
FIGS. 5 and 6 are detailed views of one manner of mounting the ground working means to the main frame.
Figure 5:
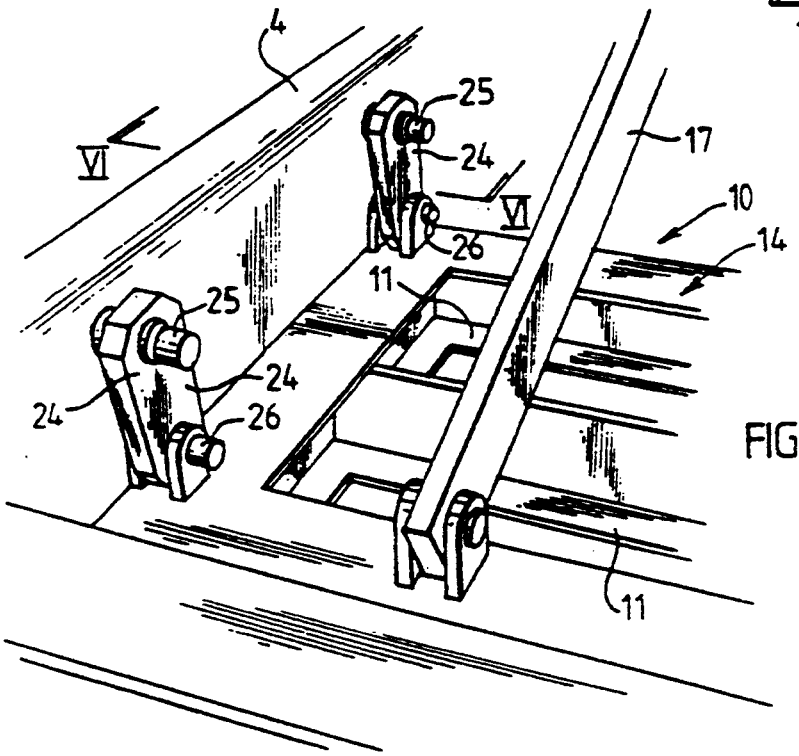

Referring to the drawings the machine generally indicated at 1 comprises a main frame 3 which is adapted to be moved over the ground being worked and ground working means 10 operatively connected to the main frame and being capable of vibratory motion relative thereto. The arrangement is such that in use the vibratory motion of the ground working means 10 as the machine is moved over the ground being worked tends to cause the ground to be levelled and tamped down and loose material to be distributed relatively evenly.

In the form of the machine shown it is adapted to be operatively connected to a vehicle such as a tractor, a backhoe or the like so that it can be drawn across the ground to be worked. It will be appreciated however that the machine could be self powered so that it can be driven over the ground to be worked.

As shown, the main frame 3 comprises a substantially rectilinear box-like structure having side members 4 and cross members 5 with an open top side and bottom side. The main frame 3 can be manufactured from any suitable material such as metal or the like. As shown, the ground working means 10 is mounted within the box-like main frame 3.

The ground working means 10 comprises a plurality of substantially parallel spaced apart ground engaging members 11 each extending laterally of the normal direction of travel of the machine. The or each member 11 includes a ground engaging surface 12 or edge which is adapted to engage the ground being worked. As shown, the ground engaging surface 12 is inclined with respect to the ground so that material tends to be directed downstream, and furthermore, the members are arranged in a plane which is inclined relative to the ground again to direct material downwardly.

The vibratory motion is in the form of oscillations applied to the ground working means 10 which cause it to move generally back and forth in the direction of travel of the machine. A vibration generating means 15 is provided and includes eccentric bearings 16 or bushes operatively connected to a rotatable shaft 19 so that rotation of the shaft causes eccentric movement of the bearings or bushes. Connector arms 17 operatively connect the bearings 16 to the ground working means 10. As shown, the ground working means 10 comprises the ground engaging members 11 and framework members 13 arranged to form a sub-frame 14 which is suspended from the main frame by a plurality of pivotal links 24 mounted on pivot pins 25 and 26, the links permitting swinging movement of the sub-frame 14 relative to the main frame 3 back and forth in the direction of travel of the machine. Alternatively the ground working means 10 may be mounted to the main frame so that it can slide relative thereto forwards and backwards to achieve the vibratory or oscillatory motion.

As shown, the drive for rotating the shaft 19 is obtained from the power and drive sources on a tractor and is transmitted to the shaft via transmission 40. The transmission 40 comprises a power take-off shaft 41 which is operatively connected to a drive on the tractor, a gear box 42 and a belt drive 43 which includes pulleys 44 and 45 and belt 46. It will be appreciated that alternatively to the above, the drive means may be in the form of a motor mounted to the main frame of the machine.

A blade member 8 may be mounted to a trailing edge portion of the main frame rearwardly of ground engaging roller 7 so as to provide a final levelling operation.

Damping devices (not shown) are provided for operatively interconnecting the ground working means and the main frame. These damping devices tend to reduce the shocks to the machine resulting from the vibratory motion.

Finally, it is to be understood that various alterations, modifications and or additions may be incorporated into the various constructions and arrangements of parts without departing from the spirit and ambit of the invention.

I claim:

1. A machine for levelling a surface, the machine being movable over the surface in a normal direction of travel and comprising:

a main frame, ground working means, mounting means operatively connecting said ground working means to said main frame for back and forth motion relative thereto in said normal direction of travel, the back and forth motion having a major component of motion in a generally horizontal direction and not more than a minor component of motion in a generally vertical direction, said ground working means including a plurality of ground engaging levelling members each having a longitudinal axis which extends laterally with respect to the normal direction of travel of the machine and collectively including a substantially flat ground engaging surface inclined continuously from a forward edge of said substantially flat ground engaging surface to a trailing edge of said substantially flat ground engaging surface with the leading edge being at a greater height above the surface being worked than the trailing edge when the machine is in use so that as the machine is moved over the surface being worked, the substantially flat ground engaging surface moving back and forth in said normal direction of travel tends to cause the surface being worked to be levelled and loose material distributed evenly, and generating means for providing said back and forth motion to the ground working means.

2. A machine according to claim 1, wherein said plurality of ground engaging members are in spaced relation one behind the other with respect to the normal direction of travel of the machine.

3. A machine according to claim 1, wherein said ground engaging members are arranged in a plane which is, in use, inclined with respect to the surface being worked with the most forward ground engaging member being at a greater height above the surface being worked than the most rearward ground engaging member.

4. A machine according to claim 1, wherein said ground working means is operatively connected to said main frame by a plurality of links one end of each link being pivotally connected to said main frame and the other end of each link being pivotally connected to said ground working means so that said ground working means is suspended by said links which permit the movement of said ground working means relative to said main frame.

5. A machine according to claim 1, wherein said generating means includes an eccentric mounted on a rotatable shaft and a connecting member operatively connecting said ground working means to said eccentric.

6. A machine according to claim 1, further including a ground engaging roller mounted on said main frame rearwardly of said ground working means with respect to the normal direction of travel of the machine.

7. A machine for levelling a surface, the machine being movable over the surface in a normal direction of travel and comprising:

a main frame, ground working means, mounting means operatively connecting said ground working means to said main frame for back and forth motion relative thereto in said normal direction of travel, the back and forth motion having a major component of motion in a generally horizontal direction and only a minimal component of motion in a generally vertical direction, said ground working means including a plurality of ground engaging levelling members each having a longitudinal axis which extends laterally with respect to the normal direction of travel of the machine and collectively including a substantially flat ground engaging surface inclined continuously from a forward edge of said substantially flat ground engaging surface to a trailing edge of said substantially flat ground engaging surface with the leading edge being at a greater height above the surface being worked than the trailing edge when the machine is in use so that as the machine is moved over the surface being worked, the substantially flat ground engaging surface moving back and forth in said normal direction of travel tends to cause the surface being worked to be levelled and loose material distributed evenly, and generating means for providing said back and forth motion to the ground working means.

8. A machine according to claim 7, wherein said plurality of ground engaging members are in spaced relation one behind the other with respect to the normal direction of travel of the machine.

9. A machine according to claim 7, wherein said ground engaging members are arranged in a plane which is, in use, inclined with respect to the surface being worked with the most forward ground engaging member being at a greater height above the surface being worked than the most rearward ground engaging member.

10. A machine according to claim 7, wherein said ground working means is operatively connected to said main frame by a plurality of links one end of each link being pivotally connected to said main frame and the other end of each link being pivotally connected to said ground working means so that said ground working means is suspended by said links which permit the movement of said ground working means relative to said main frame.

11. A machine according to claim 7, wherein said generating means includes an eccentric mounted on a rotatable shaft and a connecting member operatively connecting said ground working means to said eccentric.

12. A machine according to claim 7, further including a ground engaging roller mounted on said main frame rearwardly of said ground working means with respect to the normal direction of travel of the machine.

* * * * *